US006307519B1

(12) United States Patent
Livingston et al.

(10) Patent No.: US 6,307,519 B1
(45) **Date of Patent: *Oct. 23, 2001**

(54) MULTIBAND ANTENNA SYSTEM USING RF MICRO-ELECTRO-MECHANICAL SWITCHES, METHOD FOR TRANSMITTING MULTIBAND SIGNALS, AND SIGNAL PRODUCED THEREFROM

(75) Inventors: Stan W. Livingston, Fullerton; Jar J. Lee, Irvine; Robert Y. Loo; Juan F. Lam, both of Agoura Hills, all of CA (US)

(73) Assignees: Hughes Electronics Corporation; Raytheon Company, both of El Segundo, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/470,700

(22) Filed: Dec. 23, 1999

(51) Int. Cl.[7] ..... H01Q 13/00
(52) U.S. Cl. ..... 343/767; 343/746; 343/876
(58) Field of Search ..... 343/700 MS, 767, 343/768, 770, 746, 747, 876; H01Q 13/10

(56) References Cited

U.S. PATENT DOCUMENTS 3,813,674 * 5/1974 Sidford ..... 343/730
3,852,994 * 12/1974 Pereda ..... 73/35
4,410,890 * 10/1983 Davis et al. ..... 343/419
5,541,614 * 7/1996 Lam et al. ..... 343/792.5
5,754,143 * 5/1998 Warnagirls ..... 343/767
6,069,587 * 5/2000 Lynch et al. ..... 343/700 MS

* cited by examiner

*Primary Examiner*—Don Wong
*Assistant Examiner*—Shih-Chao Chen
(74) *Attorney, Agent, or Firm*—Vijayalakshmi D. Duraiswamy; Michael W. Sales

(57) ABSTRACT

A method and system for transmitting, and a signal comprising multiple frequency bands from a single slot antenna are disclosed. The system comprises a slot antenna and a micro-electro-mechanical (MEM) switch, coupled to the slot antenna. The MEM switch is opened and closed, thereby changing the resonant frequency of the slot antenna. The slot antenna transmits a first frequency when the MEM switch is open and a second frequency when the MEM switch is closed. The method for transmitting a first frequency and a second frequency from a slot antenna comprises the steps of transmitting the first frequency from the slot antenna, closing a micro-electro-mechanical (MEM) switch coupled across the slot antenna, therein changing the resonant frequency of the slot antenna, and transmitting the second frequency from the slot antenna after the MEM switch is closed. A signal comprising a first and second frequency in accordance with the present invention is transmitted by an array of antennas, wherein the array of antennas comprises at least one slot, the slot being reconfigurable through a RF MEM switch coupled to the slot, by performing the steps of transmitting the first frequency from the slot antenna, closing a micro-electro-mechanical (MEM) switch coupled across the slot antenna, therein changing the resonant frequency of the slot antenna, and transmitting the second frequency from the slot antenna after the MEM switch is closed.

15 Claims, 4 Drawing Sheets

MULTIBAND ANTENNA SYSTEM USING RF MICRO-ELECTRO-MECHANICAL SWITCHES, METHOD FOR TRANSMITTING MULTIBAND SIGNALS, AND SIGNAL PRODUCED THEREFROM

BACKGROUND OF THE INVENTION

1. Field of the Invention

This invention relates in general to antennas, and, in particular, to a multiband antenna array using radio frequency (RF) micro-electro-mechanical (MEM) switches.

2. Description of Related Art

Communications satellites are in widespread use. The communications satellites are used to deliver television and communications signals around the earth for public, private, and military uses.

The primary design constraints for communications satellites are antenna beam coverage and radiated Radio Frequency (RF) power. These two design constraints are typically thought of to be paramount in the satellite design because they determine which customers on the earth will be able to receive satellite communications service. Further, the satellite weight becomes a factor, because launch vehicles are limited as to how much weight can be placed into orbit.

Many satellites operate over fixed coverage regions and employ polarization techniques, e.g., horizontal and vertical polarized signals, to increase the number of signals that the satellite can transmit and receive. These polarization techniques use overlapping reflectors where the reflector surfaces are independently shaped to produce substantially congruent coverage regions for the polarized signals. This approach is limited because the coverage regions are fixed and cannot be changed on-orbit, and the cross-polarization isolation for wider coverage regions is limited to the point that many satellite signal transmission requirements cannot increase their coverage regions.

Many satellite systems would be more efficient if they contained antennas with high directivity of the antenna beam and had the ability to have the coverage region be electronically configured on-orbit to different desired beam patterns and/or frequency bands. These objectives are typically met using a phased array antenna system. However, phased array antennas carry with them the problems of being restricted to a single frequency band, as well as being limited by large efficiency losses.

If multiple frequency bands are to be used by the satellite for communications, the typical approach is to use two antennas with two reflectors, one antenna and one reflector for the first frequency band and a separate antenna and reflector for the second frequency band. This approach adds significant weight and size to the satellite, which limits the launch vehicle choices, and, typically, limits the size of the reflector that can be used for the frequency bands of interest. As such, smaller service areas result from the reduced size of the antenna system.

There is therefore a need in the art for a phased array antenna system that can use multiple frequency bands. There is also a need in the art for a phased array antenna system that has low efficiency losses. There is also a need in the art for an antenna system that can use multiple frequency bands and still cover a large service area.

SUMMARY OF THE INVENTION

The present invention discloses a method and system for transmitting multiple frequency bands from a single slot antenna. The system comprises a slot antenna and a micro-electro-mechanical (MEM) switch, coupled to the slot antenna. The MEM switch is opened and closed, thereby changing the resonant frequency of the slot antenna. The slot antenna transmits a first frequency when the MEM switch is open and a second frequency when the MEM switch is closed.

The method for transmitting a first frequency and a second frequency from a slot antenna comprises the steps of transmitting the first frequency from the slot antenna, closing a micro-electro-mechanical (MEM) switch coupled across the slot antenna, therein changing the resonant frequency of the slot antenna, and transmitting the second frequency from the slot antenna after the MEM switch is closed.

A signal comprising a first and second frequency in accordance with the present invention is transmitted by an array of antennas, wherein the array of antennas comprises at least one slot, the slot being reconfigurable through a RF MEM switch coupled to the slots by performing the steps of transmitting the first frequency from the slot antenna, closing a micro-electro-mechanical (MEM) switch coupled across the slot antenna, therein changing the resonant frequency of the slot antenna, and transmitting the second frequency from the slot antenna after the MEM switch is closed.

A system in accordance with the present invention provides a phased array antenna system that can use multiple frequency bands. A system in accordance with the present invention also provides a phased array antenna system that has low efficiency losses. Further, a system in accordance with the present invention provides an antenna system that can use multiple frequency bands and still cover a large service area.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings that form a part hereof, and in which is shown by way of illustration a specific embodiment in which the invention may be practiced. It is to be understood that other embodiments may be utilized and structural changes may be made without departing from the scope of the present invention.

Overview

Satellite communications systems require multiple signals and large coverage areas to be cost effective. Typically, a satellite system has one or more transponders operating at a certain frequency band, e.g., X-Band, Ku-Band, etc., and the satellite operates at a single frequency band to perform communications services.

The present invention allows satellite systems to operate at multiple frequency bands. The present invention uses a "tuneable" slot antenna that can radiate at different frequency bands depending on the configuration of the antenna.

The antenna configuration is altered by using Radio Frequency (RF) Micro-Electro-Mechanical (MEM) switches that change the resonating frequency of the antenna.

The present invention allows the antenna to be reconfigured as desired to transmit one, two, three, or any number of frequency bands through the same antenna aperture. Since the RF MEM switches can be opened and closed rapidly, the system can also be used to Time Division Multiple Access (TDMA) not only the signals within a certain frequency band, but also allow TDMA schemes to be used with multiple frequency bands. Further, when the RF MEM switches are closed, the phased array has additional elements, which allows for independent steering of beams using different frequency bands.

To perform the reconfiguration, a slot antenna is used that has RF MEM switches attached along the length of the microstrip fed slot radiator. To change frequency bands, the slot element is adjusted by closing the RF MEM switch. As the RF MEM switch is dosed, the resonating frequency of the slot is changed, and, as such, the slot will radiate at a different frequency than if the RF MEM switch is open.

FIGS. 1A–1G illustrate the reconfiguration of the array antenna of the present invention.

Figure 1A:
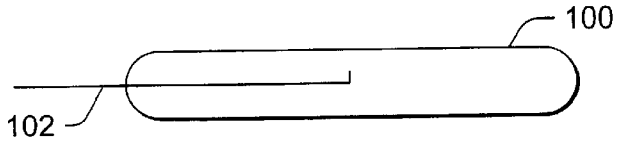
FIGS. 1A–1G illustrate the reconfiguration of the array antenna of the present invention.

FIG. 1A illustrates slot 100. In a typical slot antenna, one or more slots 100 are used to radiate a certain frequency band. Slot 100 has a resonant frequency within the frequency band that radiates from slot 100. For example, slot 100 as shown in FIG. 1A can have a resonant frequency in the S-band (1.55 through 5.2 GHz). To radiate, slot 100 is fed using a microstrip feed line 102.

Figure 1B:
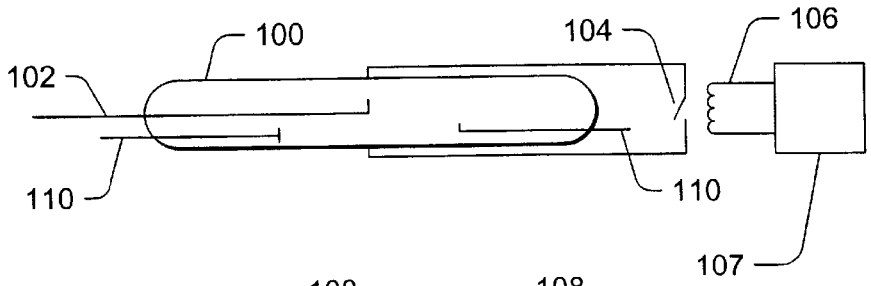
Figure 1C:
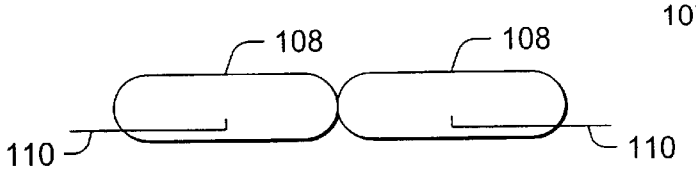

FIG. 1B illustrates slot 100 coupled to RF MEM switch 104. Bias lines 106 provide electromotive force (voltage) to open and close RF MEM switch 104. With RF MEM switch 104 open, the resonant frequency of slot 100 is unchanged. Bias lines 106 are microstrip lines, and, as such, are printed on a substrate through lithographic techniques. The bias lines 106 are less than a wavelength in thickness, and are typically a fraction of a wavelength in thickness, which avoids spurious coupling by radiation problems that could occur with the bias lines 106.

To adjust slot 100 to a new resonant frequency, RF MEM switch 104 is closed. The closing and opening of RF MEM switch 104 can be accomplished using a controller 107 or other electronic signal sending device coupled to bias lines 106. Once the closing of RF MEM switch 104 occurs, slot 100 in essence becomes two slots. The slot 100 is thus reconfigured to two slots 108 shown in FIG. 1C. Although shown with respect to a single slot 100, the present invention is applicable to an array of slots 100, where each slot 100 can be individual controlled through the use of RF MEM switches 104 for each slot 100 in the array. Slots 108 now have a different resonant frequency than slot 100 did, because the geometry of slots 108 is different. For example, slot 100 as shown in FIG. 1A can have a resonant frequency in the S-band (1.55 through 5.2 GHz), whereas slots 108 will have resonant frequencies which are approximately twice that of slot 100, e.g., in the X-band (5.2–10.9 GHz). To radiate at the new resonant frequency, slots 108 are excited by microstrip feed lines 110.

When RF MEM switch 104 is open, the nominal resonance of the slot 100 is of the first order, and are excited by microstrip feed 102 from the center. When RF MEM switch 104 is closed, the boundary condition at the middle of the slot 100 forces the slot 100 to resonate at a second order resonant frequency. The resultant slots 108 excited by microstrip feeds 110, one for each slot 108, are typically located midway between the RF MEM switch 104 and the slot 108 edge. Because the RF MEM switch 104 forms a metallic boundary, signal isolation exists between slots 108, and, as such, the phase of the signal transmitted from the first slot 108 can be uniquely controlled or shifted with respect to the signal transmitted from the adjacent slot 108, or from any other signal transmitted by slots 100 or 108 within the array of slots 100. As such, a phased array antenna system is created by the slots 100 and 108, since each slot 100 or 108 can have a uniquely controlled phase. By controlling the phase of each signal by opening and closing the RF MEM switches 104, and delaying the signals properly, a far field beam scan can be performed by moving the resultant beams created by the slots 100.

Figure 1D:
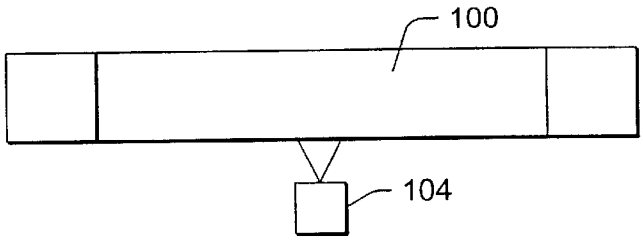

Although shown for ease of illustration as being alongside slot 100, RF MEM switch 104 is typically behind slot 100, as shown in FIG. 1D. As such, RF MEM switch 104 and bias lines 106 cross over slot 100, but, because of the location of RF MEM switch 104 and bias line 106 width, do not interfere with radiation from slot 100 or slots 108. To create slot 100 as used for the present invention, a transverse slot 100 is cut into a substrate's metal cladding, which serves as a ground plane for a microstrip line feed on one side and as the radiating aperture on the other. Above the slot 100, a gallium arsenide (GaAs) substrate is placed with an RF MEM switch 104. Vertical interconnecting vias link opposing sides of the slot 100 to the RF MEM switch 104 cantilever. Bias lines 106 carrying the voltage potential are printed on the GaAs substrate. The voltage on bias lines 106 produces the electrostatic force needed to either close or open the switch, thus creating an open or short across the slot for the multiple resonances of the slot 100.

In an array of slots 100, each slot can be individually fed by a unique amplitude or phase in a shared geometry lattice with an element to element spacing to provide grating lobe free operation over a wide scan volume.

Figure 1E:
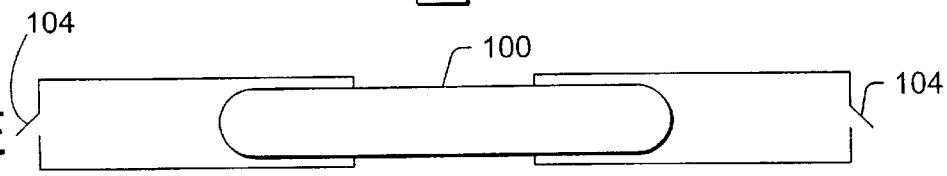
Figure 1F:
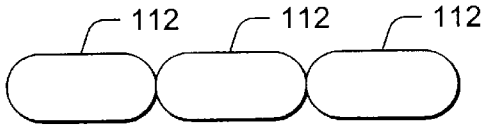
Figure 1G:
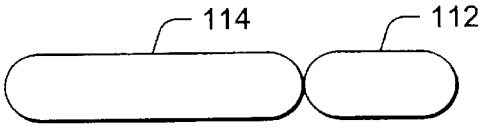

FIG. 1E illustrates multiple RF MEM switches 104 for a single slot 100. Slot 100 can be separated into more than two slots 108 as described in FIG. 1C. Slot 100 can be re-configured into as many new frequency bands as desired. For example, FIG. 1E illustrates a slot that can be re-configured into three slots 112 radiating at a different frequency band as shown in FIG. 1F, or into two slots 112 and 114, where slot 112 radiates at a first frequency band and slot 114 radiates at a second frequency band, as shown in FIG. 1G. Both the first and second frequency bands are different than the frequency band used by slot 100.

By timing the opening and closing of RF MEM switches 104 in an array of slots 100, and by correlating the timing of opening and closing of RF MEM switches with transmission of signals from the slots 100, a Time Division Multiple Access (TDMA) system results that uses multiple frequency bands within the time slots of the TDMA system. For example, a TDMA system that uses 100 millisecond (msec) time slots, and a ten time slot frame (1 second frame length) can have slot 100 radiating for the first 100 msec, close one RF MEM switch 104 shown in FIG. 1E and allow slots 112 and 114 to radiate for the second 100 msec, close both RF MEM switches 104 shown in FIG. 1E and allow three slots 112 to radiate for the third 100 msec, etc. The present invention thus allows for reconfiguration of the frequency bands within a frame or across frames of a TDMA system, by opening and closing the RF MEM switches 104 in an appropriate manner.

The typical radiating beam pattern of slots 100, 108, 112, and 114, is a bi-directional pattern forming above and below the plane of slots 100, 108, 112, and 114. However, slots 100, 108, 112, and 114 can have any beam pattern desired by placing the slots 100, 108, 112, and 114 above a wideband reflector and/or behind a wideband director to obtain hemispherical radiating beam patterns. The reflector or director can consist of frequency selective surfaces, bandwidth enhancing dielectric, or a photonic bandgap material to enhance the directivity and bandwidth of the antenna system.

Although a broadband frequency response can be obtained by providing a microstrip feed 102 that is slightly off-center with respect to slot 100, such an off-center placement of microstrip feed 102 cannot generate multi-octave performance from slot 100. Two operational bandwidths, for example, might be configured as shown in FIG. 1B, such as 15–25 GHz and 30–50 GHz. By doubling the length of the slot 100, and adding a third feed and a third set of RF MEM switches 104, it is possible to include a lower octave band such as 7.5–12.5 GHz. The limit to the number of octave bands is determined by the effectiveness of the reflector and directors over such extremely wide operational frequency bands.

Previous multi-band array elements required different or unique geometries for each frequency band, and contained only a limited number of resonant frequencies and, therefore, suffered in design or performance. For example, discrete antenna sensors are heavy, occupy a larger volume, and cause electromagnetic incompatibility, radar cross section, and observation problems. The present invention eliminates these problems by creating a single, small, multi-band aperture.

By integrating the mass-production potential of RF MEM switches with planar antenna technology, the present invention produces a phased array antenna with re-configurable elements covering a wide operational bandwidth. The present invention lowers the cost of phased array antenna systems by consolidating frequency bands, and therefore increases the number of signals that can be transmitted from a single integrated aperture. The present invention allows for a single re-configurable array antenna that can transmit multiple frequency bands in a small volume and low weight package. The present invention avoids the large packaging and weight problems associated with multiple separate antennas for each frequency band.

The slots 100 described in FIGS. 1A–1G can be placed in an array to create a high performance phased array system. By correctly spacing the slots 100, grating lobes within the antenna beam pattern are avoided. The spacing of slots 100 that avoids such deleterious effects is accomplished by overlapping the low band slots 100 in the same cell area as the high band slots 100. MEM switches 104 are placed into the slots 100 that partition the resonant slot 100 lengths while maintaining less than half-wave lattice spacing for all bands.

Other attempts at constructing multi-band antenna arrays occupying the same space suffered with large lattice spacing, thus producing unwanted grating lobes. The present invention supports a phased array scanned beam over multi-bands from a single aperture.

Switch Performance

RF MEM switches 104 have the advantage over photonic or diode switches in performance for frequencies above X-band in which the MEM losses are minimal compared to photonic or diode switches. An optically re-configurable antenna is an example of an array whose geometry can be re-configured using photonically activated RF switches. Unlike the optically re-configurable antenna, which is really an array of adjustable dipoles, the present invention uses a slot antenna that is reconfigured through the use of MEM switches 104. An advantage of the re-configurable slot over the dipole is the feature of routing bias lines 106 closer to metallic surfaces. The bias lines 106 need to be routed close to ground plane surfaces in order to avoid parasitic coupling and spurious radiation problems. The optically re-configurable dipole array uses transparent fiber optic control lines to avoid the bias line interference, which results in the use of expensive fiber optic control lines, as well as difficult assembly techniques. The present invention does not require expensive fiber optical feeds, and the bias lines 106 can be inexpensively printed on the substrate along with the RF MEM switch.

In addition, dipoles and semiconductor switches are prone to loss problems when used for millimeter wave applications. Dipole switches require a balanced transmission line feed, which is difficult to implement at the higher microwave frequencies. The RF MEM switches 104 of the present invention form a simple metal-to-metal contact short circuit across a slot 100, which, when compared to a semiconductor switch, offers lower signal losses above 10 GHz. The present invention thus provides higher frequency coverage compared to the state-of-the-art re-configurable dipole antenna using semiconductor switches.

Wideband millimeter wave coverage can be obtained by slot antennas such as a true time delay Continuous Time Scan (CTS). However, CTS is inherently adaptable to only a one dimensional scan, while the present invention addresses the problem of producing a low-cost two-dimensional scanning array for high frequency applications.

Reconfigurable Slot Antenna Array

Figure 2A:
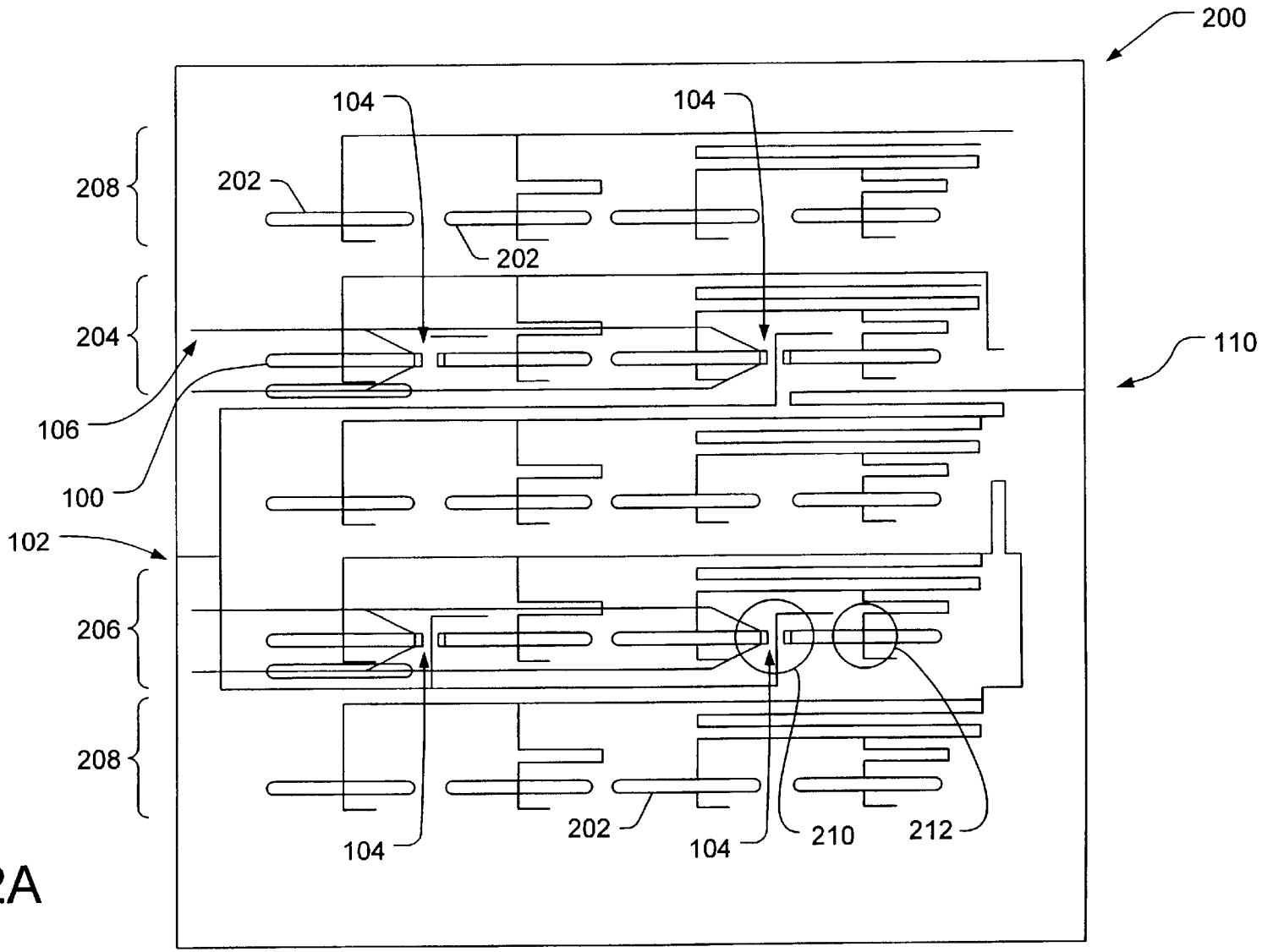
FIGS. 2A–2B illustrate an embodiment of a reconfigurable slot antenna array of the present invention.
Figure 2B:
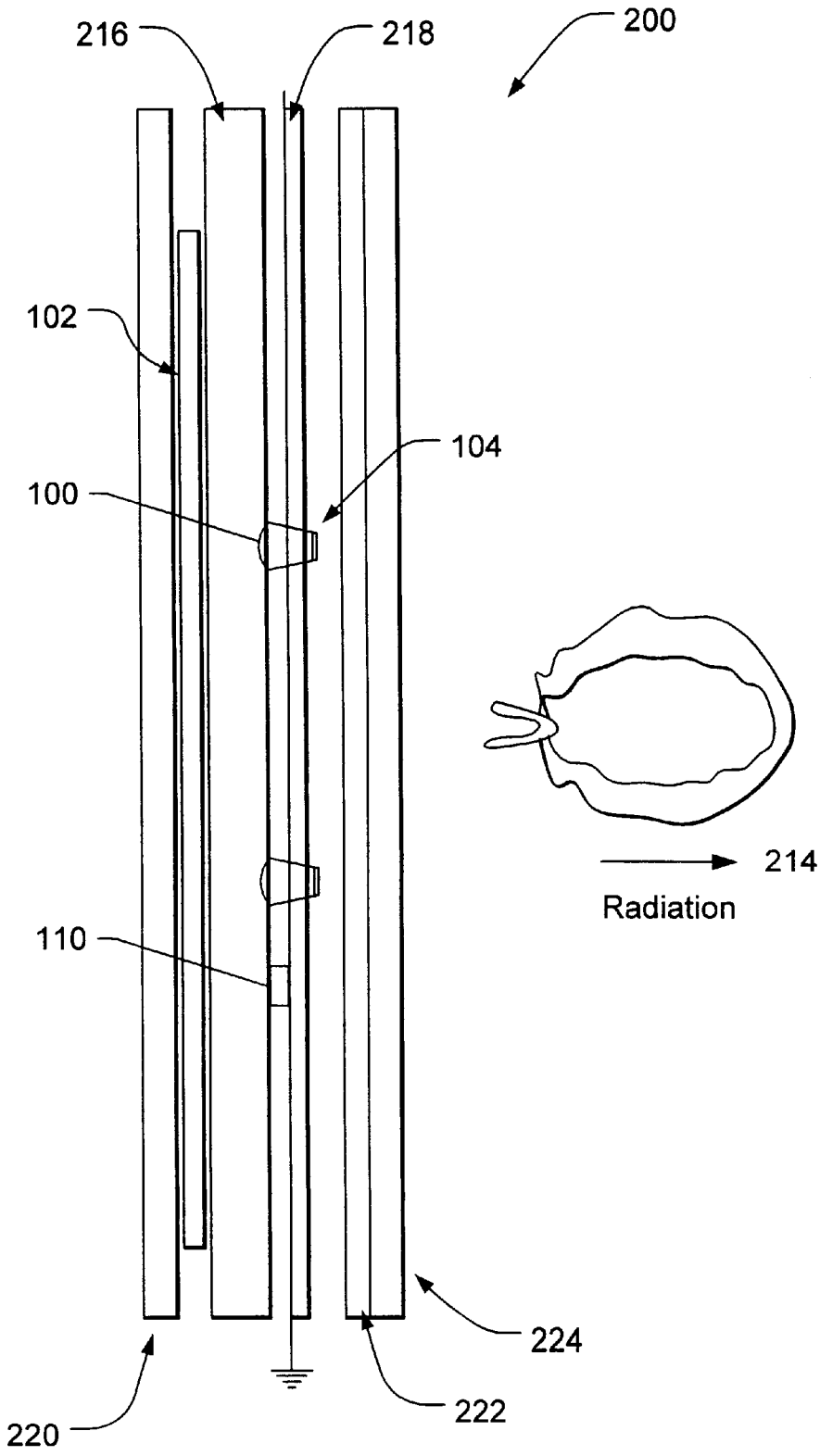

FIGS. 2A–2B illustrate an embodiment of a reconfigurable slot antenna array of the present invention.

FIG. 2A shows a multi-band antenna array 200 using RF MEM switches 104. Slots 100 and 202 are used to radiate two different frequency bands. Reconfigurable slots 100 are placed in approximately a half-wave lattice in cells 204 and 206, while high band only slots 202 are placed in cells 208. Cells 208 are interleaved within the low band unit cells 204 and 206 at approximately a half-wavelength apart at the high band frequency.

The high band only slots 202 are excited by high band microstrip lines 110. The slots 100 that can be reconfigured to transmit low band and high band frequencies are excited in the middle of the RF MEM switches 104 by low band microstrip lines 102 as shown in area 210. Slots 100 are also excited by the high band microstrip lines 110 as shown in area 212. The bias lines 106 can be cascaded together and are printed on the same substrate as the RF MEM switches 104, or for larger areas can be printed on a separate layer. The RF microstrip feed lines 102 and 110 can also incorporate an adjustable phase or true time delay circuit to allow for phase shifting of one slot 100 or 202 with respect to another slot 100 or 202. A polarizer may also be used for adjustment of the transmitted signal for either right or left hand polarization, and can also be accomplished through the use of RF MEM switch 104.

FIG. 2B illustrates a side view of the antenna array 200 of the present invention. As discussed above, slots 100 and RF MEM switches 104 are located in the radiation 214 path of the antenna array 200. Slots 100 are located on substrate 216, whereas RF MEM switches 104 are located on a separate gallium arsenide (GaAs) substrate 218. A reflector 220 is placed on one side of substrate 216 to reflect the radiation from the slots 100 in a single direction instead of the typical bi-directional pattern generated by slots 100 in a slot antenna array. Director 222 is placed in the radiative direction of slots 100 to shape the radiation 214 emanating from slots 100. Polarizer 224 can also be placed in the radiative direction to polarize the radiation 214 if desired.

Process

Figure 3:
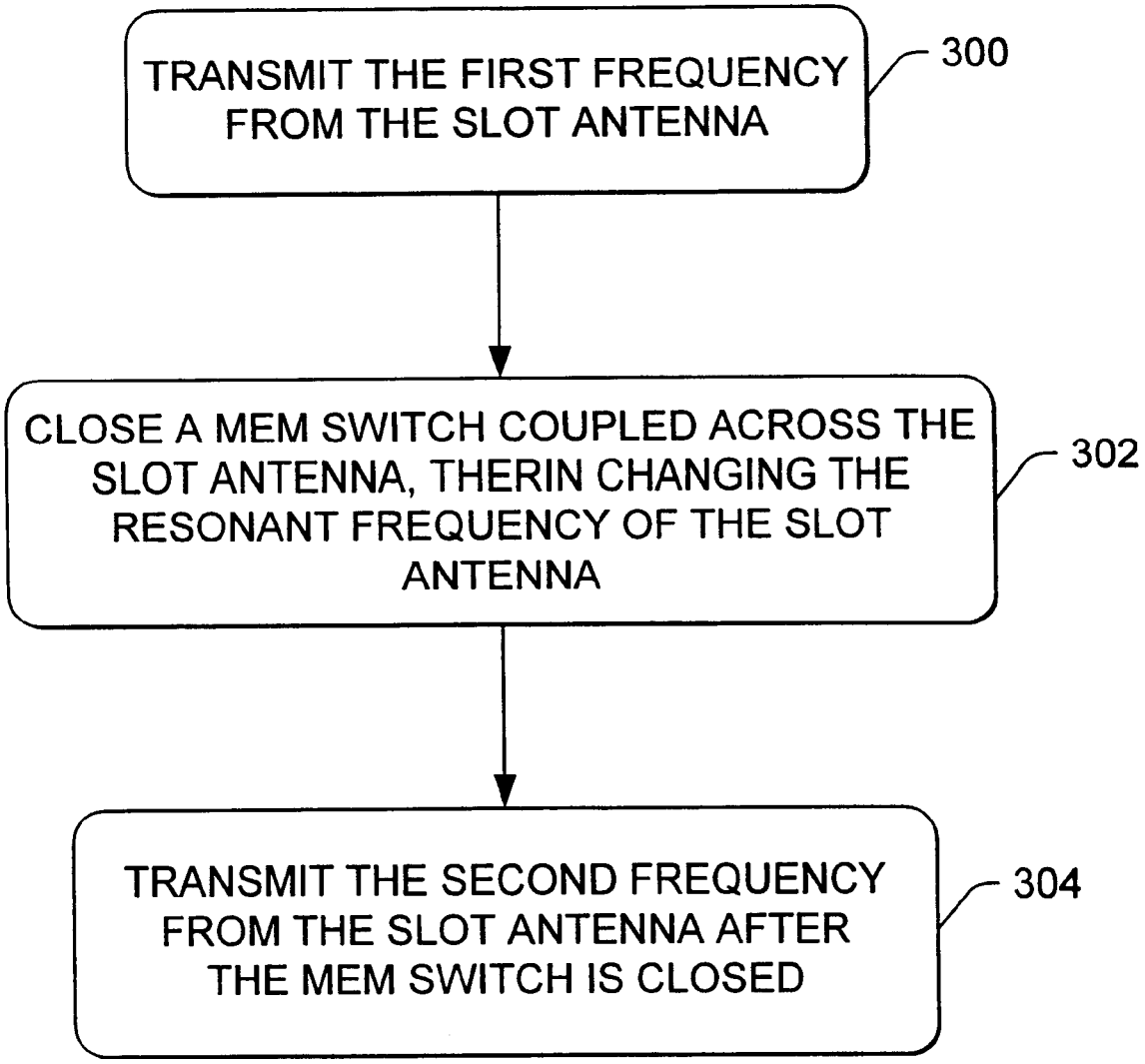
FIG. 3 is a flow chart illustrating the steps used in practicing the present invention.

FIG. 3 is a flowchart illustrating the steps used to practice the present invention.

Block 300 illustrates the present invention performing the step of transmitting the first frequency from the slot antenna.

Block 302 illustrates the present invention performing the step of closing a micro-electro-mechanical (MEM) switch coupled across the slot antenna, therein changing the resonant frequency of the slot antenna.

Block 304 illustrates the present invention performing the step of transmitting the second frequency from the slot antenna after the MEM switch is closed.

The techniques described in the present invention can be used to make smaller low-power satellites economically feasible, as well as the ability to more completely utilize present satellite configurations.

In summary, the present invention provides a method and system for transmitting multiple frequency bands from a single slot antenna. The system comprises a slot antenna and a micro-electro-mechanical (MEM) switch, coupled to the slot antenna. The MEM switch is opened and closed, thereby changing the resonant frequency of the slot antenna. The slot antenna transmits a first frequency when the MEM switch is open and a second frequency when the MEM switch is closed.

The method for transmitting a first frequency and a second frequency from a slot antenna comprises the steps of transmitting the first frequency from the slot antenna, closing a micro-electro-mechanical (MEM) switch coupled across the slot antenna, therein changing the resonant frequency of the slot antenna, and transmitting the second frequency from the slot antenna after the MEM switch is closed.

A signal comprising a first and second frequency in accordance with the present invention is transmitted by an array of antennas, wherein the array of antennas comprises at least one slot, the slot being reconfigurable through a RF MEM switch coupled to the slot, by performing the steps of transmitting the first frequency from the slot antenna, closing a micro-electro-mechanical (MEM) switch coupled across the slot antenna, therein changing the resonant frequency of the slot antenna, and transmitting the second frequency from the slot antenna after the MEM switch is closed.

The foregoing description of the preferred embodiment of the invention has been presented for the purposes of illustration and description and is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An antenna system, comprising:

a slot antenna; and a micro-electro-mechanical (MEM) switch, coupled to the slot antenna, for changing the resonant frequency of the slot antenna, wherein the slot antenna has a first resonant frequency when the MEM switch is open and a second resonant frequency and a third resonant frequency when the MEM switch is closed, wherein when the MEM switch is closed, the slot is fed by more than one input signals.

2. The antenna system of claim 1, wherein the slot antenna comprises an array of slots, wherein at least one slot of the array of slots is coupled to a MEM switch.

3. The antenna system of claim 1, further comprising a controller for opening and closing the MEM switch, wherein the slot antenna transmits a first frequency when the MEM switch is open and a second and third resonant frequency when the MEM switch is closed.

4. The antenna system of claim 3, wherein the controller opens and closes the MEM switch to implement a time-division multiple access (TDMA) transmission scheme.

5. The antenna system of claim 1, wherein the multiple input signals are out of phase with respect to each other.

6. A method for transmitting a plurality of frequencies from a slot antenna, comprising the steps of:

transmitting the first frequency from the slot antenna;

closing a micro-electro-mechanical (MEM) switch coupled across the slot antenna, therein changing the resonant frequency of the slot antenna to a second resonant frequency and third resonant frequency; and transmitting the second and third resonant frequencies from the slot antenna after the MEM switch is closed;

wherein when the MEM switch is closed, the slot is fed by more than one input signals.

7. The method of claim 6, further comprising the steps of:

opening the MEM switch; and transmitting the first frequency from the slot antenna after the MEM switch is open.

8. The method of claim 7, further comprising the steps of:

opening the MEM switch; and transmitting the first frequency from the slot antenna after the MEM switch is open.

9. The method of claim 7, wherein the steps of opening and closing the MEM switch are performed by a controller.

10. The method of claim 6, wherein the multiple input signals are out of phase with respect to each other.

11. A satellite communications system, comprising:

a satellite including a slot antenna; and a micro-electro-mechanical (MEM) switch, coupled to the slot antenna, for changing the resonant frequency of the slot antenna, wherein the slot antenna has a first resonant frequency when the MEM switch is open and a second resonant frequency and a third resonant frequency when the MEM switch is closed;

wherein when the MEM switch is closed, the slot is fed by more than one input signals.

12. The satellite communications system of claim 11, wherein the slot antenna comprises an array of slots, at least one slot in the array of slots being coupled to the MEM switch.

13. The satellite communications system of claim 11, wherein the MEM switch is opened and closed by a controller.

14. The satellite communications system of claim 13, wherein the controller opens and closes the MEM switch to create a TDMA transmission schema.

15. A signal to be transmitted by an array of antennas, wherein the array of antennas comprises at least one slot, the slot being reconfigurable through a RF MEM switch coupled to the slot, the signal comprising a plurality of frequencies, wherein the signal is transmitted by performing the steps of:

transmitting the first frequency from the slot antenna;

closing a micro-electro-mechanical (MEM) switch coupled across the slot antenna, therein changing the resonant frequency of the slot antenna to a second resonant frequency and a third resonant frequency; and transmitting the second and third resonant frequencies from the slot after the MEM switch is closed;

wherein when the MEM switch is closed, the slot is fed by more than one input signals.

* * * * *

UNITED STATES PATENT AND TRADEMARK OFFICE

CERTIFICATE OF CORRECTION

PATENT NO. : 6,307,519 B1
DATED : October 23, 2001
INVENTOR(S) : Livingston et al.

It is certified that error appears in the above-identified patent and that said Letters Patent is hereby corrected as shown below:

Column 2,
Line 20, that portion of the sentence reading "coupled to the slots" should read -- coupled to the slot --.

Column 7,
Line 62, "one input signals" should read -- one input signal --.

Column 8,
Line 19, "one input signals" should read -- one input signal --;
Lines 24-27, cancel the entire claim 8 which reads:
"8. The method of claim 7, further comprising the steps of:
opening the MEM switch; and
transmitting the first frequency from the slot antenna after the MEM switch is open.", and
insert the following claim:
-- 8. The method of claim 6, wherein the steps of opening and closing the MEM switch are performed by a controller. --;
Lines 28-29, cancel the entire claim 9 which reads:
"9. The method of claim 7, wherein the steps of opening and closing the MEM switch are performed by a controller.", and
insert the following claim:
-- 9. The method of claim 8, wherein the controller controls the opening and closing of the MEM switch to create a TDMA transmission schema. --;

UNITED STATES PATENT AND TRADEMARK OFFICE

CERTIFICATE OF CORRECTION

PATENT NO. : 6,307,519 B1
DATED : October 23, 2001
INVENTOR(S) : Livingston et al.

It is certified that error appears in the above-identified patent and that said Letters Patent is hereby corrected as shown below:

Column 8 (cont.),
Line 41, "by more than one input signals" should read -- by more than one input signal --;
Line 65, "by more than one input signals" should read -- by more than one input signal --.

Signed and Sealed this

Thirtieth Day of April, 2002

*Attest:*

*Attesting Officer*

JAMES E. ROGAN
*Director of the United States Patent and Trademark Office*